US009546079B1

(12) United States Patent
Mercier

(10) Patent No.: US 9,546,079 B1
(45) Date of Patent: Jan. 17, 2017

(54) SELF-STABILIZING HOIST APPARATUS FOR LIFTING SYSTEM

(71) Applicant: Craig Mercier, Pasadena, MD (US)

(72) Inventor: Craig Mercier, Pasadena, MD (US)

( * ) Notice: Subject to any disclaimer, the term of this patent is extended or adjusted under 35 U.S.C. 154(b) by 0 days.

(21) Appl. No.: 15/042,504

(22) Filed: Feb. 12, 2016

Related U.S. Application Data

(60) Provisional application No. 62/115,441, filed on Feb. 12, 2015.

(51) Int. Cl.
*B66C 1/16* (2006.01)
*B66C 1/10* (2006.01)
*B66C 1/62* (2006.01)

(52) U.S. Cl.
CPC ..... *B66C 1/101* (2013.01); *B66C 1/16* (2013.01); *B66C 1/625* (2013.01)

(58) Field of Classification Search
CPC ..... B66C 1/101; B66C 1/16; B66C 1/18; B66C 1/625; B66F 9/187; B62B 2203/44
USPC ..... 294/67.4, 67.41, 119.2
See application file for complete search history.

(56) References Cited

U.S. PATENT DOCUMENTS 1,332,234 A * 3/1920 Raidt ..... B66C 1/16 294/74
2,076,758 A * 4/1937 Whiting ..... B66C 1/12 294/119.2
2,384,307 A * 9/1945 Husson ..... B66C 1/10 294/119.2
2,831,720 A * 4/1958 Renfroe ..... B66C 1/625 24/265 R
2,966,380 A * 12/1960 Swenson ..... B66C 1/125 294/119.2
3,052,441 A * 9/1962 Fleischman ..... B62B 3/104 248/141
3,212,469 A * 10/1965 Kershaw ..... B66C 1/62 102/293
4,009,898 A * 3/1977 Hampton ..... B66C 1/625 294/119.2
4,826,228 A * 5/1989 Dinitz ..... B66C 1/14 294/67.1
5,944,474 A * 8/1999 Cummins ..... B62B 3/104 294/119.2
6,036,247 A * 3/2000 Gertz ..... B66C 1/625 294/106
6,416,096 B1 * 7/2002 Stefanik ..... H01J 9/003 29/758

(Continued)

*Primary Examiner* — Dean Kramer
(74) *Attorney, Agent, or Firm* — Rosenberg, Klein & Lee

(57) ABSTRACT

A self-stabilizing hoist apparatus for a lifting system is provided for re-positioning articles which, due to their weight and form, are not readily movable manually. The apparatus includes a support section, a collar section, and a plurality of stabilization members. The support section is adapted for securement to the lifting system, and the collar section is coupled to the support section by the plurality of stabilization members which extend therebetween. The collar section is reconfigurable between open and closed configurations and includes a plurality of arm portions each pivotally coupled to at least one other of the arm portions. At least first and second ones of the arm portions terminate at a free end. The collar section in the closed configuration defines a loop slipped about for capturing the article. In the open configuration, free ends of the arm portions are detached from one another to interrupt the loop.

18 Claims, 9 Drawing Sheets

(56) References Cited

U.S. PATENT DOCUMENTS 8,393,659 B2 * 3/2013 Stroh ..... B66C 1/30
294/67.3

* cited by examiner

SELF-STABILIZING HOIST APPARATUS FOR LIFTING SYSTEM

RELATED APPLICATION DATA

This Application is based on Provisional Patent Application No. 62/115,441, filed 12 Feb. 2015.

BACKGROUND OF THE INVENTION

In a wide variety of applications, there is a need to re-position barrels, containers, equipment, or other such articles which, due to their weight and form, are not readily movable manually. One example of these applications is found in the context of traffic safety barriers. In areas where there is a particular danger of a collision occurring or where construction is taking place, sand barrels are lined along the roadway intended to take impact and to be somewhat of a giving barrier. The barrels are filled with sand or other powdery/particulate substance, or even water, and are large enough to be of considerable weight when filled, typically between 800 and 3000 pounds. The sheer weight of the barrels makes them cumbersome and therefore, to move the barrels from one location to another is a tedious and time consuming process. The articles are bulky enough and heavy enough that safe re-positioning requires some form of powered or other mechanical assist. A tractor, fork lift, skid steer, or other such vehicle may be available to provide powered lifting and moving capabilities, but significant time consuming and labor intensive measures are typically required to ensure proper securement to the vehicle's lifting mechanism for safe and stable lift and movement.

For instance, at the present time, the repositioning of such barrels occurs in one of two ways. First, the repositioning is accomplished manually by an individual construction or municipal worker, for example. In such cases, the barrels are generally first emptied so that they are light enough for an individual to lift and move with relative ease from one position to another. Man power is required not only to empty or drain the containers but also to physically move them from one location to the next. Therefore, this approach to effectuating the repositioning is physically demanding and rather costly based upon the time-consuming nature of such efforts.

Alternatively, repositioning of the barrels may be accomplished mechanically with the aid of a construction or utility vehicle. When mechanical means are used to assist with the repositioning, a skid steer (for example, a BOBCAT, skid steer or other such utility vehicle) is often used to pick up the barrels, one at a time for repositioning them at another location along a roadway. However, it is noted that the use of such equipment does not completely eliminate the need for manual assistance because once the barrels have been initially picked up, because of their typically bulky structural configuration and the manner in which the weight of the contents may re-distribute within the barrels themselves, they must be strapped down in some way to ensure that they are balanced on the lifting bucket, fork, or other mechanism provided on the particular machine used to effectuate repositioning. There are no straps or other such product heretofore known in the art particularly suited for such an operation. Generally, one simply settles for a makeshift securement device such as a ratchet strap or a chain and binding. Aside from raising serious safety and reliability concerns, such impromptu devices contribute to the time consuming and cumbersome nature of the process of moving the barrel as they have to be undone after each barrel is moved and re-secured for subsequent movement of the barrel. Other factors contributing to the time consuming nature of conventional repositioning measures include the bulky size of the barrels and the manner in which they are clustered together along a roadway. Such factors make it difficult to maneuver a skid steer, or other suitably accommodated machinery, around the barrels to gain clear access to a barrel that is to be moved.

There is therefore a need for a mechanism that enables the barrels to be simply and conveniently picked up from one position and re-set at another in a safe, effective, and efficient manner.

SUMMARY OF THE INVENTION

It is an object of the invention to provide a hoist apparatus which is adapted for securement to a lifting system such that a container can be both lifted from a first location and repositioned to a second location by the same mechanism.

It is another object of the invention to provide a hoist apparatus having a collar section which is reconfigurable between open and closed configurations to accommodate containers of various predetermined sizes.

It is a further object of the invention to provide a hoist apparatus having stabilization members extending between the support section and the collar section to maintain the container in a balanced manner during lifting and transport.

These and other objects are attained by a self-stabilizing hoist apparatus for a lifting system including a support section for securement to the lifting system and a collar section coupled to the support section by a plurality of stabilization members extending therebetween. The collar section is reconfigurable between open and closed configurations and includes a plurality of arm portions. Each of the arm portions are pivotally coupled to at least one other of said arm portion and at least first and second ones of the arm portions terminate at a free end. The collar section, section in the closed configuration defines a loop for capturing a container, with the free ends of said first and second arm portions releasably locked to one another and the free ends of the first and second arm portions are detached from one another in the open configuration to interrupt the loop.

In other embodiments, a self-securing hoist apparatus for a lifting system is provided including a support section for securement to the lifting system and a collar section coupled to the support section by a plurality of stabilization members extending therebetween. The collar section is reconfigurable between an open configuration and a closed configuration and includes a plurality of arm portions. Each of the arm portions are pivotally coupled to at least one other of said arm portions and at least first and second ones of the arm portions terminate at a free end. The arm portions are displaceable with respect to one another to selectively adjust the space peripherally bounded thereby when in the closed configuration. The self-securing hoist apparatus also includes at least one lock member for detachably coupling the free ends of said first and second arm portions. Wherein, the collar section in the closed configuration defines a self-securing cuff about a container with the free ends of the first and second arm portions releasably locked to one another by one of the releasable lock members and the free ends of the first and second arm portions are detached from one another in the open configuration to interrupt the cuff.

In certain other embodiments, a self-stabilizing hoist apparatus for a lifting system is provided including a support section for securement to the lifting system. The support section defines a frame with a plurality of first connection portions and an attachment member positioned thereon for releasable coupling to a securement portion of the lifting system, whereby the hoist apparatus is suspended from the lifting system. The hoist apparatus also includes a reconfigurable collar section coupled to the support section by a plurality of collapsible stabilization members. Each one of the stabilization members extends between the support section and the collar, said collar section being selectively adjustable between an open configuration and a closed configuration and including at least a first arm portion and a second arm portion, said first and second arm portions being pivotally displaceable about one end and terminating at an opposing a free end, said arm portions being displaceable in cooperative manner to adaptively adjust said collar section in shape and size about a barrel when in the closed configuration; at least one releasable lock member releasably engaging the free ends of said first and second arm portions in an active position to maintain said collar section in the closed configuration; wherein said collar section in the closed configuration defines a loop for capturing the barrel, with the free ends of said first and second arm portions releasably locked to one another by said releasable lock member, the free ends of said first and second arm portions being detached from one another in the open configuration to interrupt the loop.

DESCRIPTION OF THE PREFERRED EMBODIMENTS

In broad concept, a self-stabilizing hoist apparatus is provided having a collar section which is reconfigurable between open and closed configurations such that it may be quickly and simply looped about a given article, such as a sand barrel, or the like, with minimal manual effort. Once the collar section is cuffed about a given article, the barrel may then be hoisted by a lifting system and transported to a different location down site with its contents in place, as opposed to removing all or part of the contents just to accommodate the move. In accordance with certain embodiments of the subject apparatus, this process of lifting a sand barrel and moving the same a measurable distance may be effected with safety, stability, ease, and speed. Once the collar section of the hoist apparatus is situated about the body of a preselected article, for instance, it self-adjusts to cuff the article in adaptively balanced manner when lifted by a lifting system, such as provided on a transport vehicle.

Figure 1:
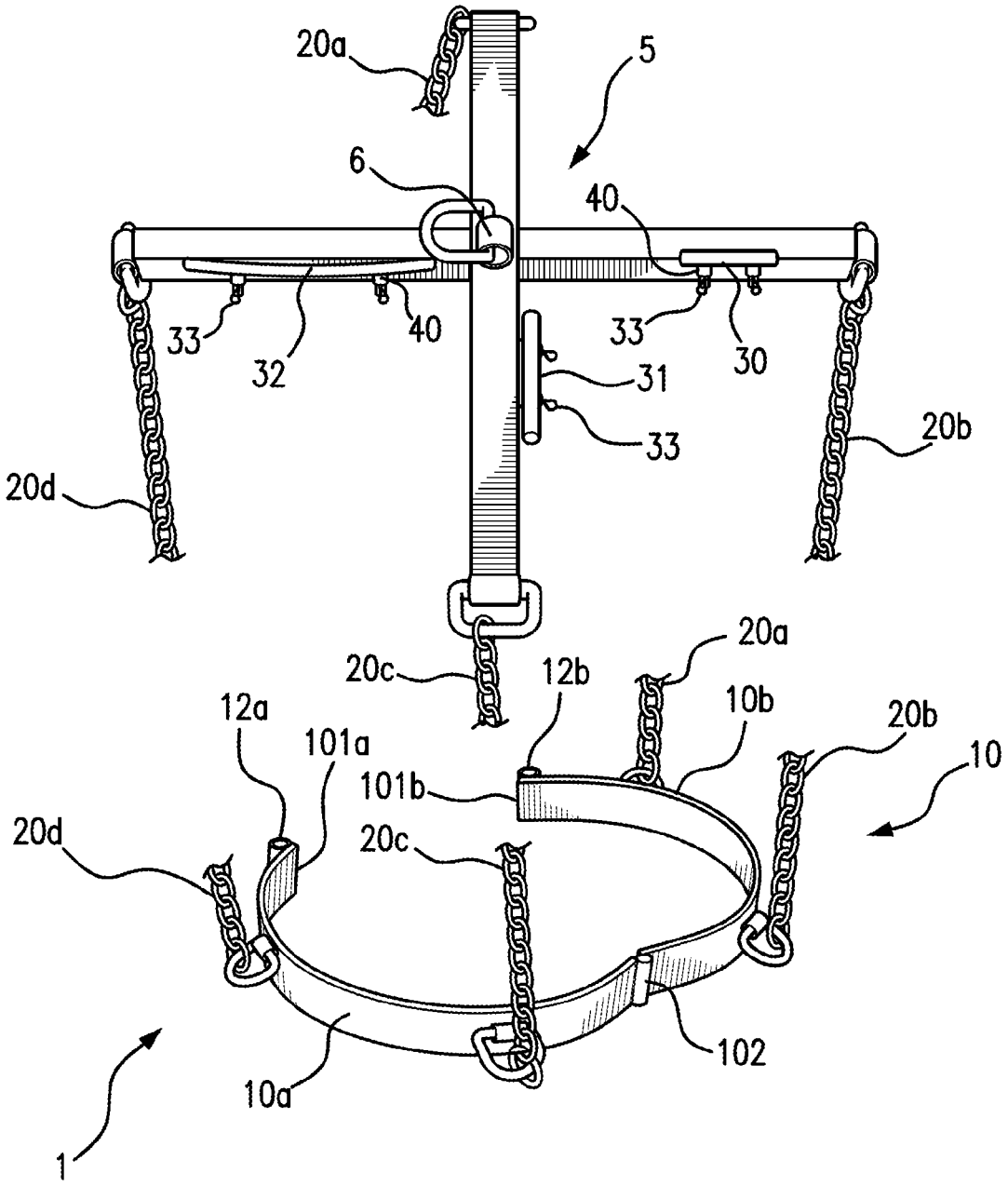
FIG. 1 is a perspective view, partially cut away, of a hoist apparatus formed in accordance with an exemplary embodiment of the present invention shown with a collar section in an open configuration and the stabilization members slack.
Figure 2:
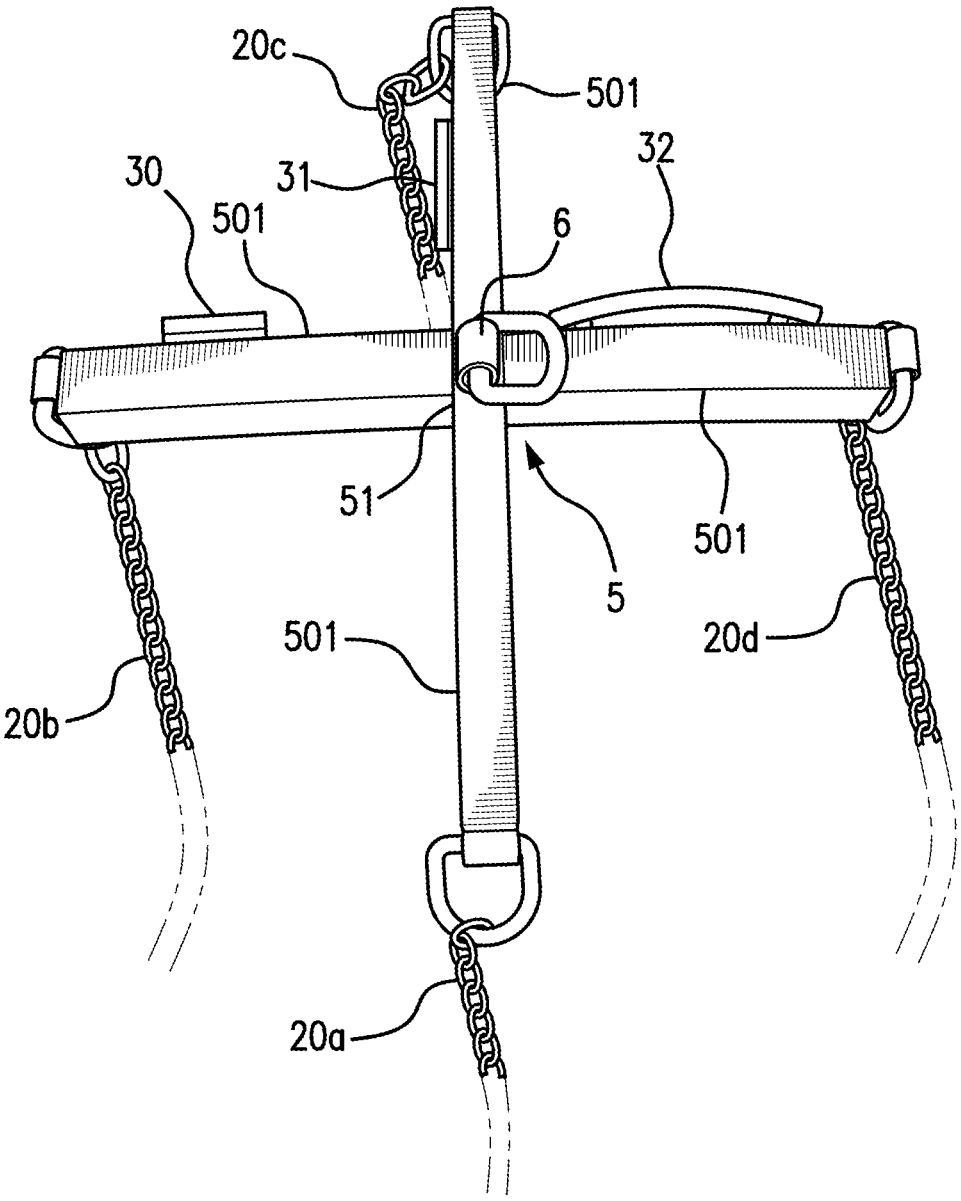
FIG. 2 is a perspective view, partially cut away, of a portion of the embodiment of FIG. 1, showing a support section attached to stabilization members and releasable lock members stowed thereon.
Figure 3:
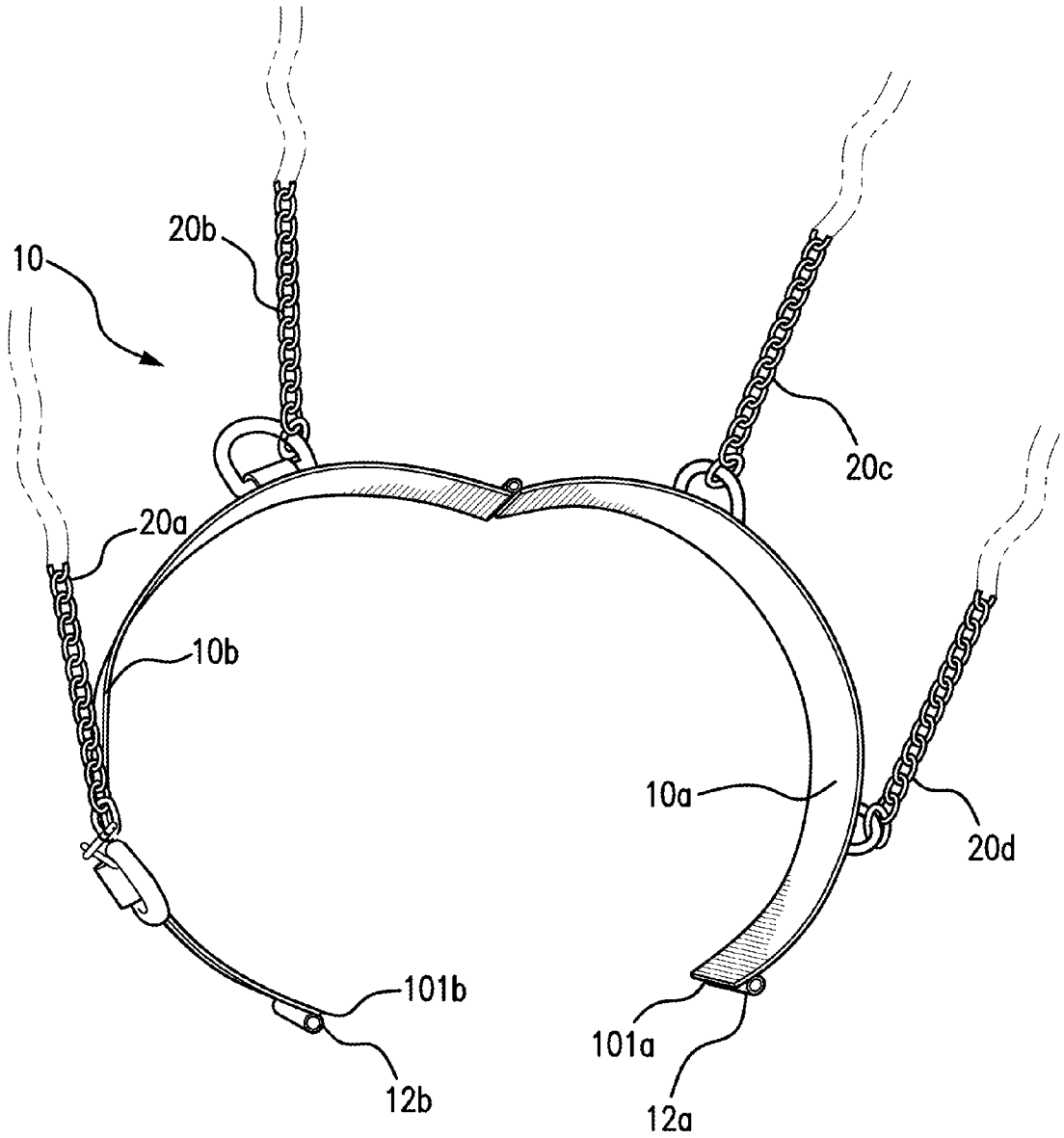
FIG. 3 is a perspective view, partially cut away, of a portion of the embodiment of FIG. 1, showing the collar section with arm portions thereof pivotally spread apart in an open configuration.

Referring to FIGS. 1-3, a hoist apparatus 1 formed in accordance with one exemplary embodiment of the present invention comprises a support section 5 and a collar section 10 which are coupled to one another by a plurality of stabilization members 20*a*-20*d*. The collar section 10 is reconfigurable between open and closed configurations and includes a plurality of arm portions. Preferably, each of the arm portions is pivotally coupled to at least one other arm portion. In the embodiment illustrated, the collar section 10 includes a first arm portion 10*a* pivotally coupled directly to a second arm portion 10*b*. In certain alternate embodiments, one or more intermediate arm portions may be linked between these first and second arm portions 10*a*, 10*b*.

Figure 4:
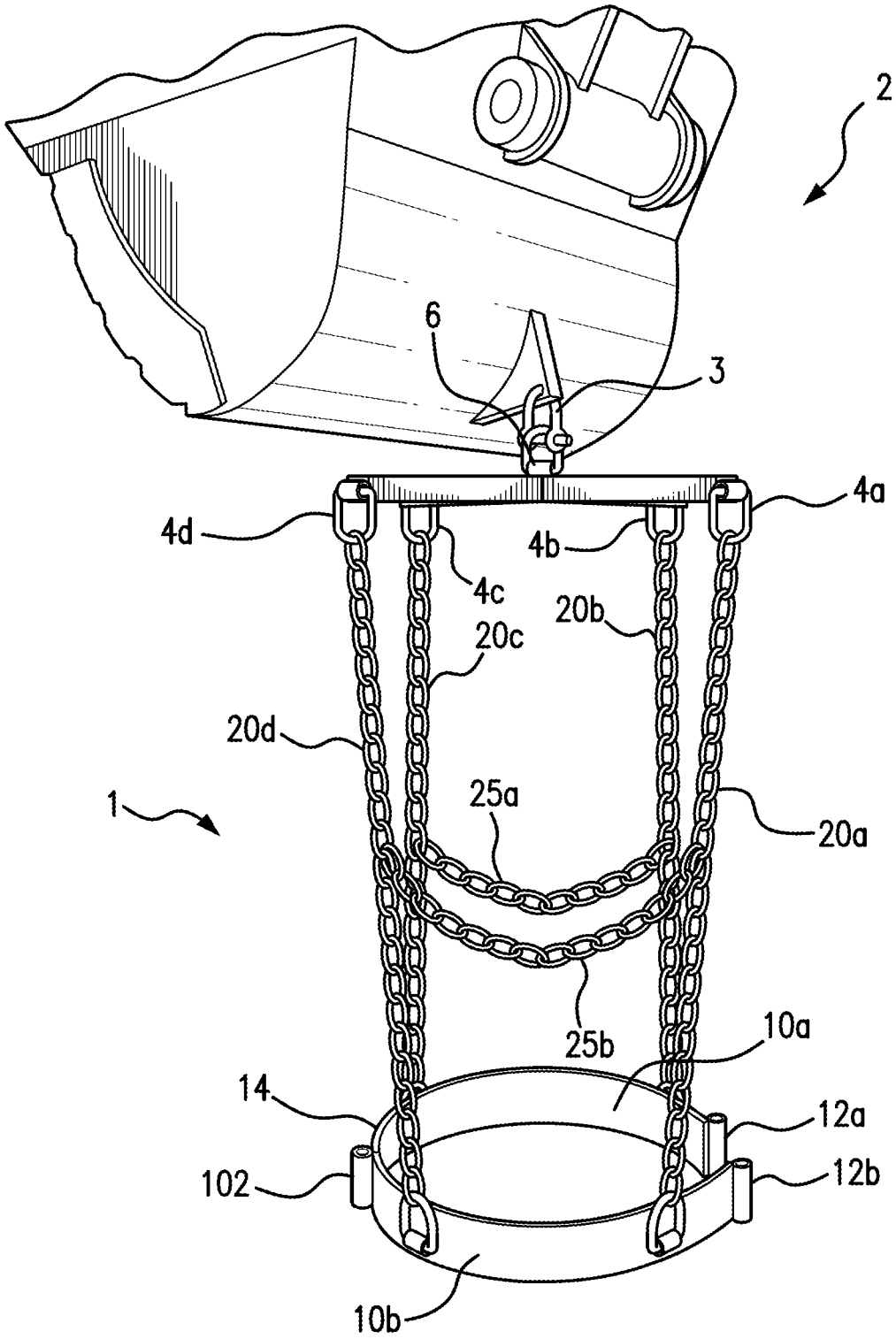
FIG. 4 is a perspective view showing the hoist apparatus embodiment of FIG. 1 attached to a lifting system in an illustrative application, the collar section being in an open configuration in preparation to engage an article for operation.

The first and second arm portions 10*a*, 10*b* are pivotally displaceable in cooperative manner about a hinge 102 as illustrated in FIGS. 1, 3, and 4. Other suitable mechanisms may be utilized in place of hinge 102 which allow for adaptive adjustment of the collar section in shape and size about a barrel, container, equipment, or other such article in the closed configuration. The arm portions 10*a*, 10*b* terminate at respective free ends 101*a*, 101*b* and are radially displaceable with respect to one another to selectively adjust the space peripherally bounded thereby when in the closed configuration.

The support section 5 includes an attachment member 6 secured thereto for reversible coupling of the support section 5 to a securement portion 3 of a lifting system 2 which may be, for instance, in the form of an excavator or other suitably accommodated piece of machinery. In certain embodiments, as shown in FIG. 4, the lifting system 1 is equipped with a securement portion 3 which provides a convenient attachment point for the support section 5. As shown in FIG. 4, the securement portion 3 may be formed for example as a clasping mechanism having a carabiner or other such suitably accommodated structural configuration which allows for the releasable coupling of the support section 5 to the lifting system 2, and which enables the hoist apparatus 1 to be suspended from the lifting system 2 in a secure, balanced manner. The securement portion 3 as shown in FIG. 4 is provided for illustrative purposes only and may be replaced with, for example, a swivel, or any other suitable mechanism known in the art, which would enable the portion to be turned or rotated freely.

In operation, once the hoist apparatus 10 is attached to the lifting system 1, it may be lifted so that the stabilization members 20*a*-20*d* are pulled taut much in the manner illustrated in FIG. 4. While stabilization members 20*a*-20*d* are shown as chains or linked members in FIG. 4, such is provided for exemplary purposes only, and other structural configurations may be employed and a variety of different materials may be utilized so long as the structure and materials yield suitable strength to support and maintain stable balance for a wide range of article size, weight, and configuration to be lifted and moved from one location to another in the intended application. Then, arm portions 10*a*, 10*b* of collar section 10 are displaced with respect to one another, effectively wrapping about to cuff a mid-portion of the article (such as a sand barrel or other suitably accommodated container). The free ends 101*a*, 101*b* of first and second arm portions 10*a*, 10*b* are then releasably locked to one another to generate a closed configuration by a lock member bridging the gap between the free ends 101*a*, 101*b* of the arm portions 10*a*, 10*b*. In this closed configuration, the collar section 10 defines a reconfigurable loop for capturing a container therein. Release of the arm portions 10*a*, 10*b* from one another leads to an open configuration of the collar section 10, wherein the loop is interrupted to facilitate placement of the collar 10 about a container, or removal therefrom after relocation has been completed.

Figure 5:
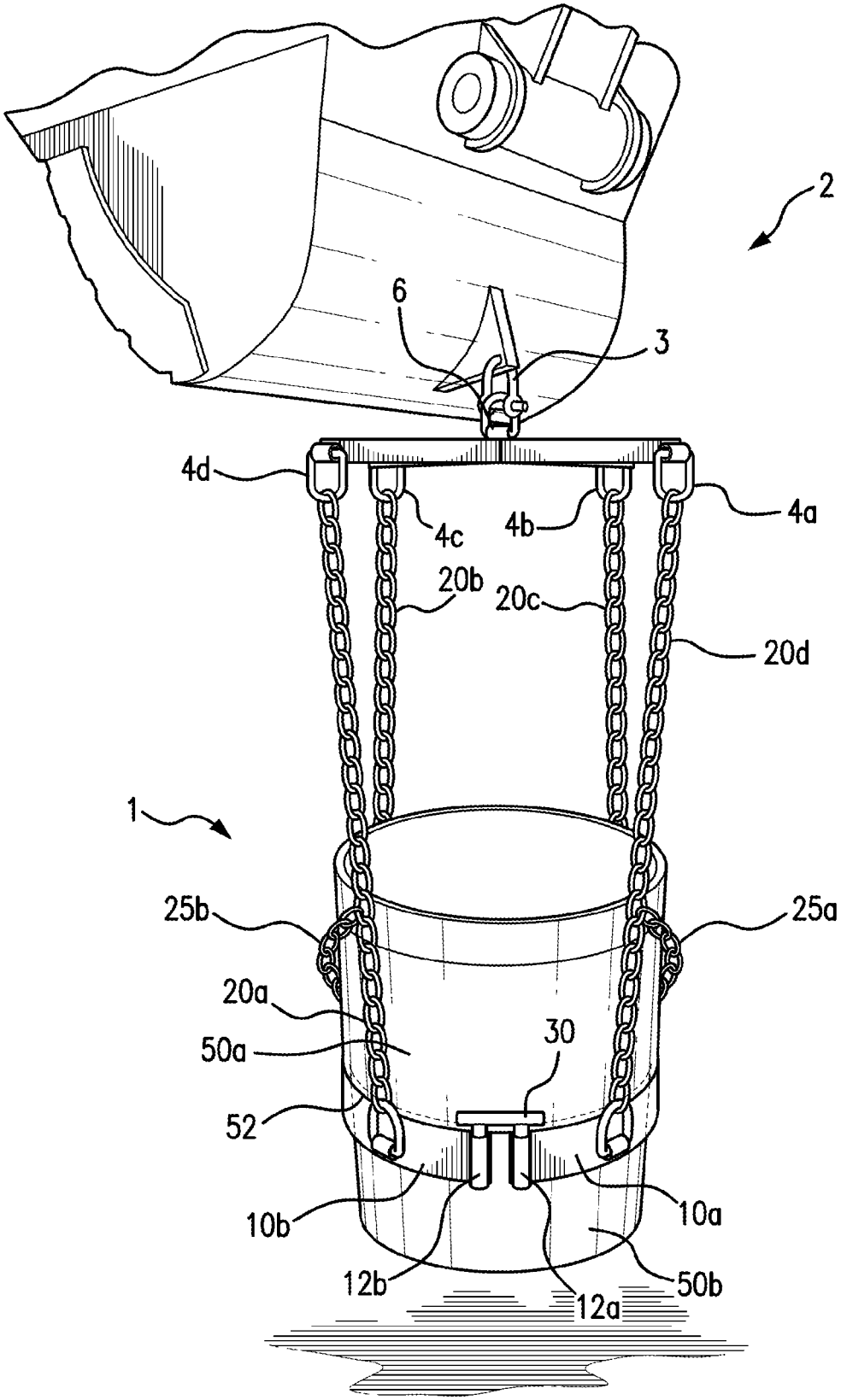
FIG. 5 is a perspective view showing the hoist apparatus in the application illustrated in FIG. 4, wherein the collar section is in a closed configuration cuffed about an article for lifting operation.
Figure 6A:
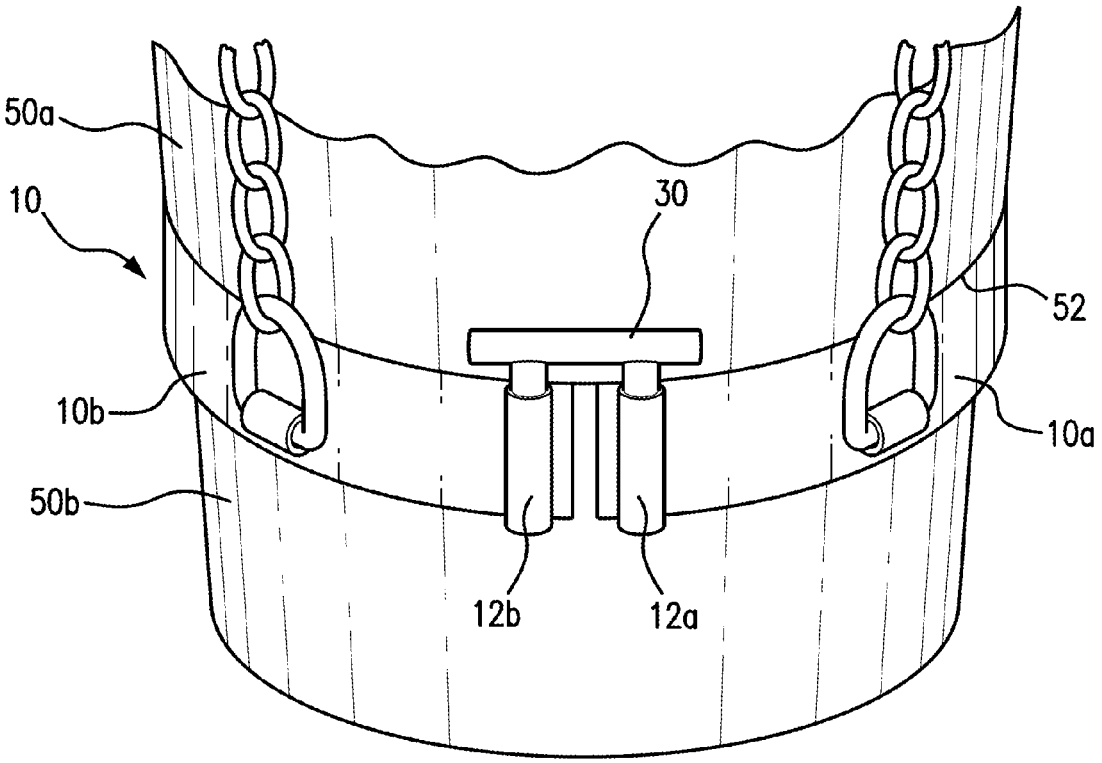
FIG. 6A is an enlarged perspective view, partially cut away, of a portion of the hoist apparatus in operation as illustrated in FIG. 5, with the collar section engaging a lip of an illustrative article having a barrel structure.
Figure 6B:
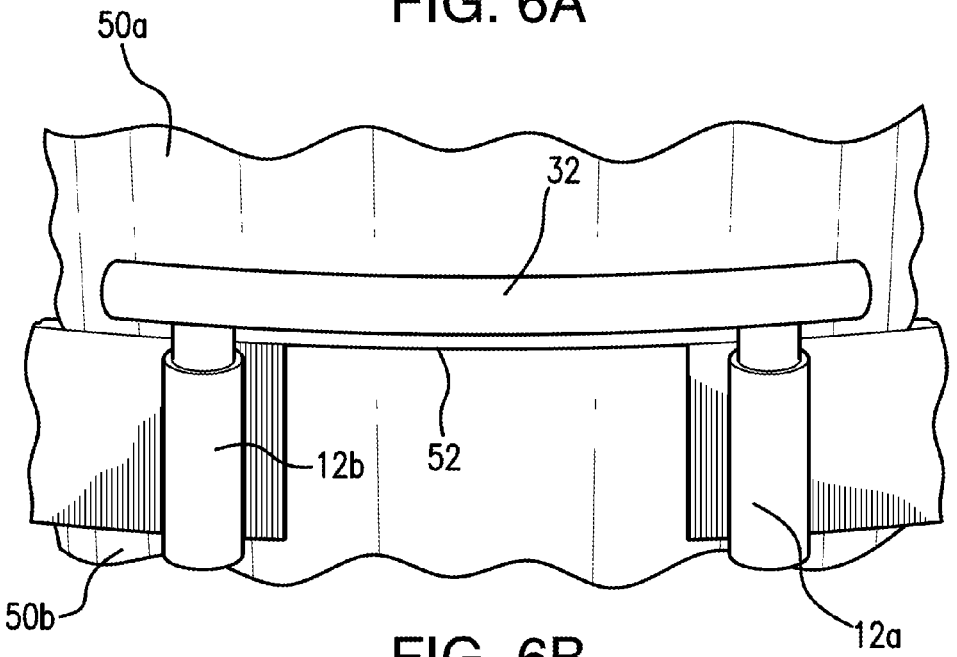
FIG. 6B is an enlarged perspective view, partially cut away, of a portion of the hoist apparatus during operation in an application similar to that of FIG. 6A, but with the collar section locked in an alternate closed configuration by use of a different lock member to accommodate a barrel-like article of different size.
Figure 8:
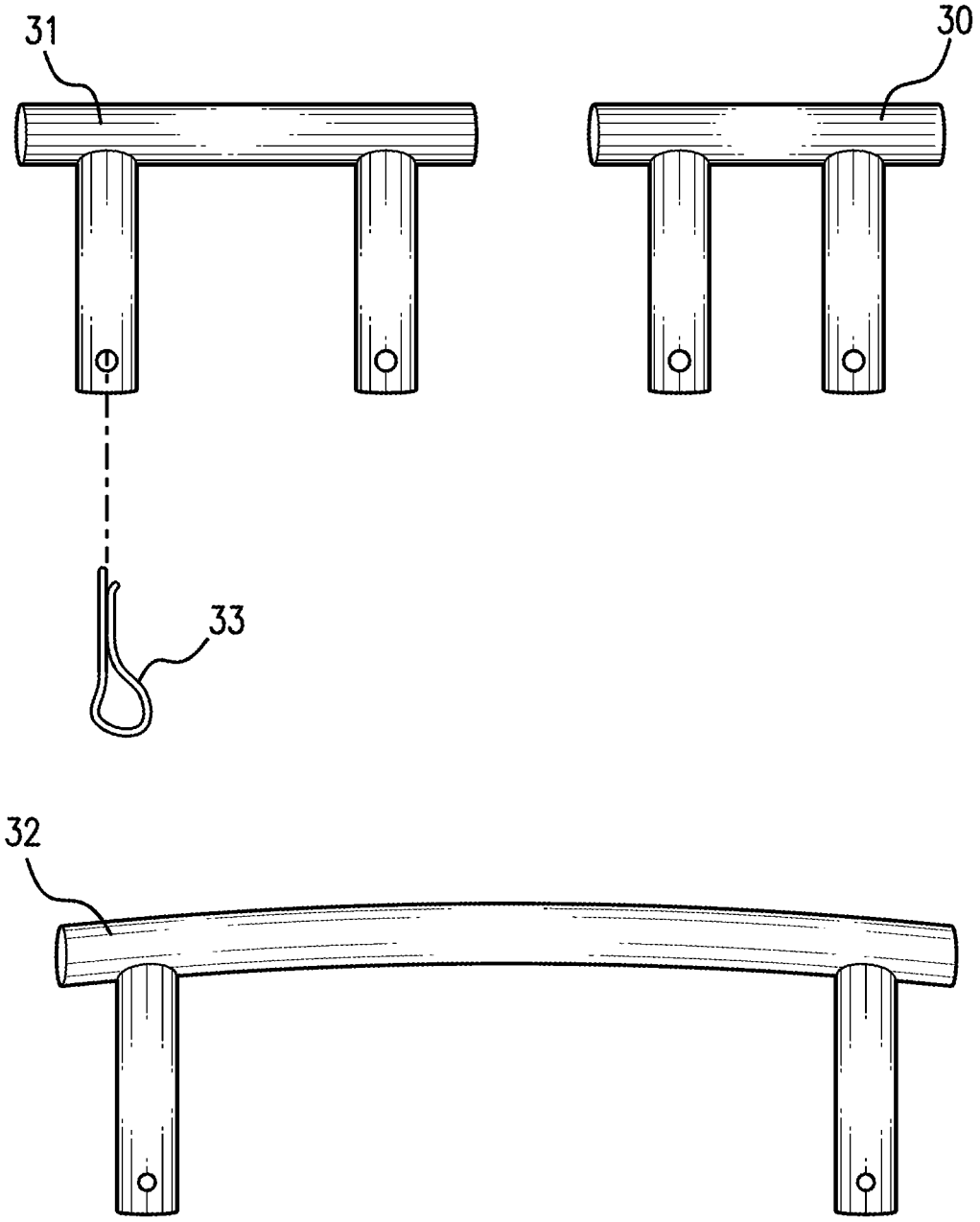
FIG. 8 is a perspective view illustrating examples of various lock members of different sizes formed in accordance with an exemplary embodiment of the present invention, which may be employed with the embodiment of FIG. 1; and, FIG. 9 is an exploded perspective view, partially cut away, illustrating the engagement of a sample lock member with the free ends of the first and second arm portions of the collar section for releasable locking in a closed configuration.

A releasable lock member 30-32 is utilized to couple the free ends 101*a*, 101*b* of first and second arm portions 10*a*, 10*b* in a releasably locked manner, as illustrated in FIGS. 5, 6A, 6B, and 9. In FIGS. 5, 6A, 6B, and 9, the lock member is shown to be a pi shaped pin which engages a connection bore 12*a*, 12*b* defined at the free ends 101*a*, 101*b* of the first and second arm portions 10*a*, 10*b*. One example of the mating engagement of releasable lock member 30 into connection bores 12*a*, 12*b* is shown FIG. 9. While formed as pi shaped pins in the exemplary embodiment shown, any other lock member configuration and structure suitable for simply yet securely maintaining the free ends 101*a*, 101*b* of the arm portions in a closed configuration to define a loop for capturing a barrel, container (or other such article) may be employed. Preferably a plurality of alternatively selectable pins 30, 31, 32 as shown in FIG. 8 are provided in a variety of sizes defining different bridging lengths between the free ends of the first and second arm portions when releasably locked thereto, such that the collar section 10 in the closed configuration defines a self-securing cuff about a container. When the hoist apparatus is not in its operational configuration, the selectable pins 30, 31, 32 are preferably stowed directly within a housing unit 40 on the crossed frame 5 of the device much in the manner as shown in FIGS. 3-5.

As shown, the support or other section of the apparatus 1 may be provided with suitable hoops or other structural formations for retaining one or more of the locking members 30-32 stowed thereon when not in use. With the dual-legged pin structure of the lock members 30-32 employed in the illustrated embodiment, a suitable fastener such as a cotter pin 33, for example, may be coupled to an end of the lock member pin legs, as shown to keep the lock members safely stowed. Other suitable retentive holding measures and other suitable fastening members may be employed in alternate embodiments of the apparatus 1.

In accordance with the exemplary embodiment illustrated, the collar section 10 is attached to the support section 5 by a plurality of stabilization members 20*a*-20*d* (four in the example illustrated), as shown in FIG. 4. The chains are preferably though not necessarily of substantial the same spanning length between the support and collar sections 5 and 10, so that the hoisted article/container is maintained in a substantially level/upright orientation when it is lifted by the hoist apparatus 1. Once the collar section has been looped around the container and the free ends secured to one another such that the collar section defines a self-securing cuff loosely about or near a base of the given container, lifting of the collar section 10 pulls it upward about the container until the loop is substantially filled by the container's girth. At that point, the collar section retentively engages the body of the container, and continued lifting of the container also lifts the container therewith. That is, the container is responsively wedged within the lifted collar section 10, due to its tapered configuration and weight, when the collar section is lifted thereabout. Although the lifting weight is heavy, damage to the containers themselves, which are typically made of plastic or other such materials, is minimized because the weight bearing contact is distributed around the collar section 10.

In the application shown, the body of the container is forms an external engagement rim or lip 52, where the body's diametric or transverse dimension transitions enough to catch the collar section 10 as it is lifted thereabout. As described in following paragraphs, the collar section 10 is then securely tucked underneath the engagement rim/lip 52 for heightened stability and security of hold about the container.

Figure 9:
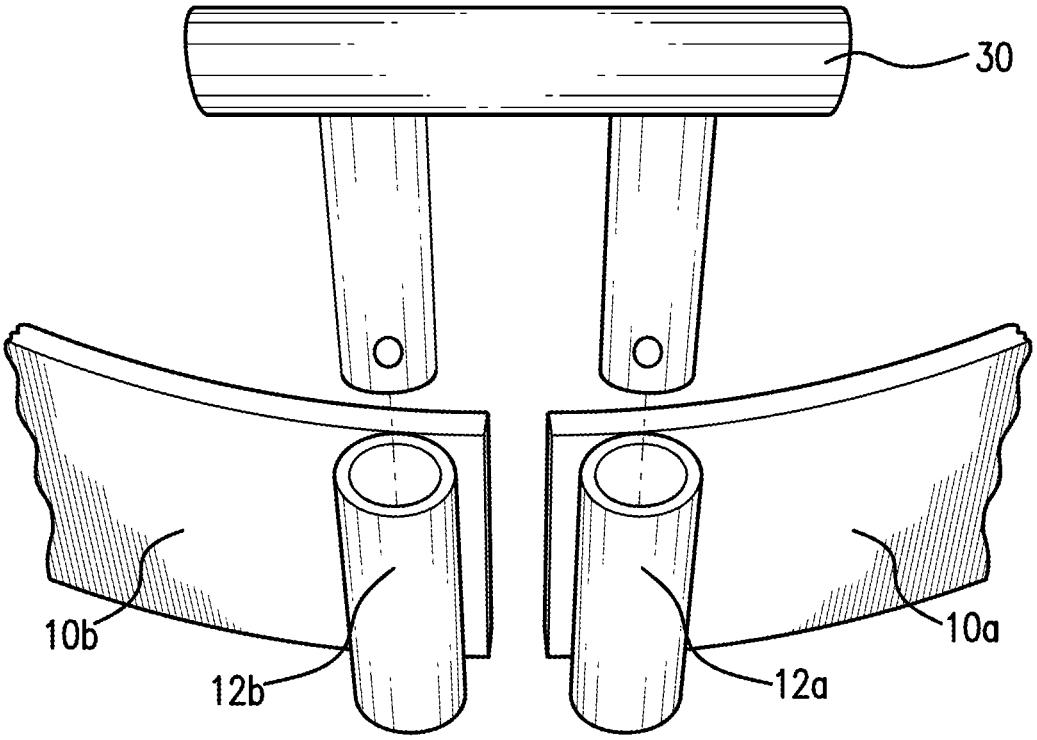

The self-stabilizing adjustable hoist apparatus 1 is more specifically formed in the exemplary embodiment shown with a crossed frame 5, collar portion 10, lifting chains 20*a*-20*d* and support chains 25*a*-25*b*. The collar 10 is preferably hinged at a central position thereof to divide the collar 10 into two arm portions 10*a*, 10*b* and to enable the collar to open and close. The open ends 12*a*, 12*b* of arm portions 10*a*, 10*b* respectively, are preferably secured together by a selected one of the pins 30, 31, 32 as shown in FIGS. 9, 10, 11 respectively. The hoist apparatus also includes two side chains 25*a*, 25*b* each connected between a pair of adjacent stabilizing chains. In certain exemplary embodiments, as shown in FIG. 4, reinforcement members 25*a*, 25*b* are provided preferably though not necessarily in the form of chains, which are respectively connected between lifting chains 20*a*, 20*b* and 20*c*, 20*d*.

The containers encountered in different applications often are configured such that they are filled with sand in its intermediate-to-upper portions, which raises their center of gravity. Therefore, the containers tend to be top heavy. The reinforcement members 25*a*, 25*b* provide additional support, particularly to prevent such top heavy barrels or other such containers from tipping when they are being maneuvered by the hoist apparatus from one position to another. Additionally, when the barrel is hoisted from the ground, the collar portion 10 may cuff the barrel or container at a point that is lower than its midpoint, and in that case, the center of gravity is going to be offset from the center of the collar so it will tend towards tipping, especially with the barrel's considerable weight accentuating its top heaviness.

The reinforcement members/chains 25*a*, 25*b* serve to basically contain a barrel, container, or the like within the space peripherally bounded by the stabilization members 20*a*-20*d* and to thereby reinforce the stability of the barrel during lifting. The reinforcement chains 25*a*, 25*b* serve as traversing barriers which help to block the opening and limit the intermediate separation between neighboring stabilization members 20*a*-20*d*.

While the disclosed embodiment as seen in FIGS. 4 and 5 provide for two reinforcement members 25*a* and 25*b*, such is provided for illustrative purposes only. If employed, the reinforcement members may be employed in various numbers, at various positions, and between various pairs of adjacent stabilization members 20*a*-20*d*, depending on the requirements of the intended application. For example, three reinforcement members may be provided to span the spaces between each neighboring pair of stabilization members 20*a*-20*d* except across the space above the free ends of the collar section 10. Such structural arrangement would avoid unduly obstructing the opening between adjacent stabilization members at/near the collar section's free ends when open, for ease of maneuverability of the collar section 10 around a container to be secured thereby. Still, an additional reinforcement member could be employed nevertheless, in certain embodiments, with the additional reinforcement member being detachably coupled at least at one end between this pair of adjacent stabilization members also. In that case, the additional reinforcement member could be detached from one of the stabilization members, and then once the collar section is placed around the container and secured in its closed configuration by one of the pi-shaped pins, the additional reinforcement member could be re-attached so that the container would be fully encircled collectively by reinforcement member. The particular number and configuration of reinforcement members and manner of connectivity are variable depending on the particular goals and objectives of a given application.

In certain embodiments, the support section 5 includes a crossed frame 51 defining a plurality of cross members 501. An attachment member 6 is secured to the top of the cross member 501 which is used to fasten the support section 5 to a securement portion 3 of the lifting system 2. The outermost ends of each cross member 501 may be equipped with attachment rings 4*a*-4*d* as illustrated in FIGS. 4 and 5. From each of the attachment rings 4*a*-4*d*, stabilization members 20*a*-20*d* of lengths suitable for the intended application extend laterally downward to a respective attachment portion along the circumference of the collar section 10.

When certain releasable lock members are not in use, they are preferably stowed in suitably accommodated housing units 40 formed on the support section 5 such as illustrated, for example, in FIGS. 1 and 2. In FIGS. 1 and 2, it can be seen that housing units 40 are suitably accommodated structured and configured to retain pi shaped pins 30, 31, 32 (releasable lock members) of different sizes. While the releasable lock members are shown to be stowed on the support section 5 in FIGS. 1 and 2, housing units 40 may alternatively be formed on the collar section 10. Still further, while it is preferable to have housing units upon the hoist apparatus itself, it is possible that releasable lock members may be remotely stowed in a housing or other suitable container separate from the hoist apparatus itself.

The variety of different sized releasable lock members 30, 31, 32 such as illustrated in FIG. 8 are beneficial in as much as they define different bridging lengths between the collar section's free ends of first and second arm portions when releasably locked thereto. This enables the collar section to be retained in a variety of different closed configurations, so as to adjustably capture containers of various sizes. If the hoist apparatus 1 is going to be utilized to maneuver a barrel which is bulkier, bigger, or wider than that which would fit within the loop formed by attachment with pin 30, for example, one of the other wider or longer pi-shaped pins 31 or 32 shown in FIG. 8 may be suitably used instead.

The largest pin 32 in this example may extend over a foot long and therefore when it is attached, there is a large gap between two ends of the collar section, yielding a collar section loop of correspondingly larger diametric extent. The pin 32 is configured to sufficiently bridge that relatively lengthy gap. Therefore, as can be seen in FIGS. 1 and 2, the largest pin 32 is preferably configured with an arcuate contour so that it effectively continues the arcuate shape of the collar section 10. In other words, the pin 32 forms an effective extension of the first and second arm portions 10*a*, 10*b* of the collar section 10. A separate securement mechanism to ensure the pin's retention across the free ends 10*a*, 10*b* may be provided, but is not typically necessary in applications of the type disclosed. That is, when the hoist apparatus is raised to lift a container up off the ground, the top of collar section 10 as well as the releasable lock member itself bear up against the bottom of the lip on the barrel 52. Thus, both a circumferential tension and downward pressure are applied on the pin (releasable lock member). The pin will tend to remain in place, and it would be difficult even to pull the pin out from engagement with the free ends 101*a*, 101*b* of the first and second arm portions 10*a*, 10*b* when the apparatus is in use and under load (assuming, of course, that the pin was properly aligned and engaged to the connection bore 12*a*, 12*b* of respective free ends 101*a*, 101*b* as shown in FIGS. 5, 6 and 9). In alternate embodiments and/or applications, the releasable lock member shown as pins 30, 31, 32 may be replaced with one or more members of other suitable structures known in the art, such as a built-on latch, even one that may be extendable as well as releasable.

As can be seen in FIG. 5, when the hoist apparatus is in an operational configuration, there is slack in the reinforcement members 25*a* and 25*b*. This does not interfere with the proper functioning of the device, as the weight of the load bears largely on the collar section 10 itself, and the reinforcement members 25*a* and 25*b* primarily guard against severe tipping and side-to-side displacement of the lifted container.

However, the reinforcement members 25*a* and 25*b* are preferably secured to stabilization members 20*a*-20*d* chains, for example, by a clip resembling a key ring, and the reinforcement members 25*a* and 25*b* may be manipulated so that excessive slack may be removed by folding a member 25*a*, 25*b* upon itself and re-securing with the key ring. Alternatively, if desired for a particular application, the reinforcement members 25*a* and 25*b* may be configured to be shorter so that when attached, they are more taught in arrangement between the stabilization members 20*a*-20*d*.

Figure 7:
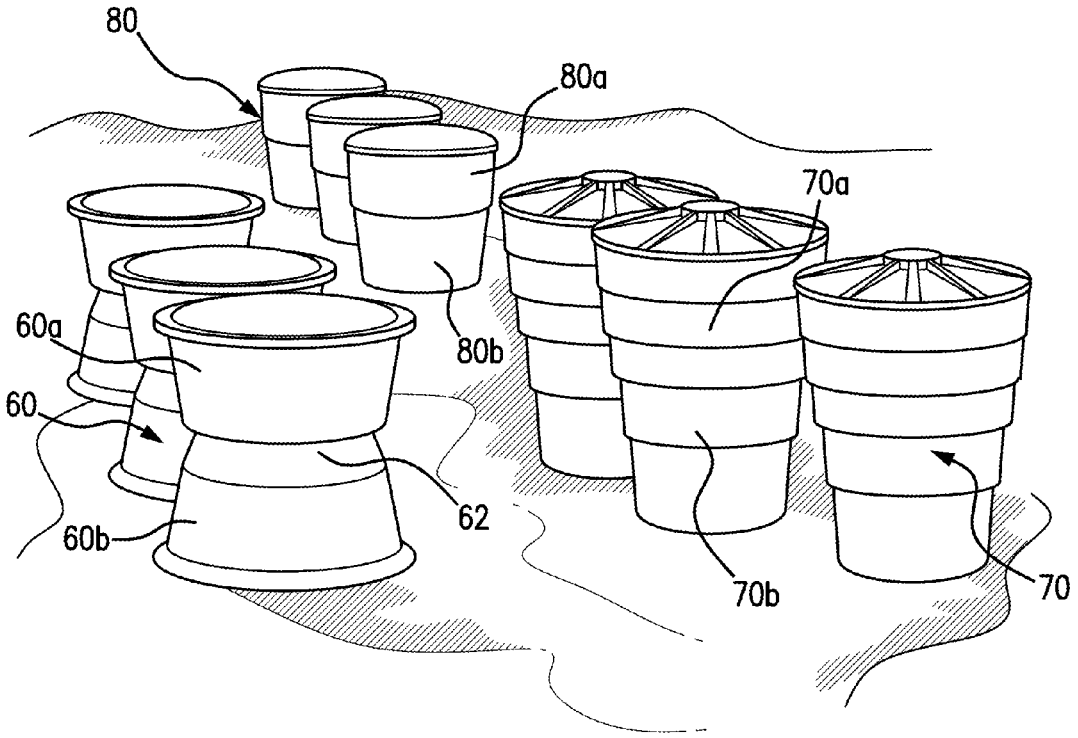
FIG. 7 is an illustrative view showing examples of barrel-like articles embodying a variety of configurations, which may be hoisted by use of the hoist apparatus embodiment of FIG. 1.

The particular barrel example shown for the article being lifted in FIG. 6 includes a body formed with a bulging section 50*a* which is offset from the bottom section 50*b* to create a convenient shoulder, rim, or lip structure, under which the collar section 10 may be tucked for secure cuffing about the barrel. Such is provided for illustrative purposes only, and the hoist apparatus may be used in conjunction with other variously articles, such as sand barrels and the like, further examples of which are illustrated in FIG. 7. With reference to FIG. 7, variations in barrel size and shape are shown, where the bodies of the barrels (typically formed of a dense plastic or other such molded material) are divided by one or more band-like raised portions into multiple portions (upper, lower, intermediate). Depending on the particular requirements of the intended application, the given barrels may be filled with sand or other fill material to weigh the barrel down. The material may be filled up to different portions 60*a*, 70*a*, 70*a*, 60*b*, 70*b*, 80*b*. For example, each of the barrels may be filled with varying amounts of sand, and the barrels may have incremental markers applied to indicate the fill line for sand or other fill material corresponding, for instance, to 200 lbs, 400 lbs and 600 lbs of resulting load. The more a barrel is filled, the more it tends toward top-heaviness when lifted by grasping or cuffing a lower portion of its body.

With respect to barrel 60, the barrel may in certain applications be of the type where the lower portion 60*b* is merely a support, and filling occurs only in the upper portion 60*a*. Therefore, when the barrel is hoisted and maneuvered from one location to another, with the collar section 10 is disposed generally around the barrel's midpoint 62, the barrel tends to be particularly top-heavy. In maneuvering such a barrel, the reinforcement members 25*a* and 25*b* tend to be situated closer to the collar section than they would for maneuvering for instance a barrel configured such as shown in FIG. 5. Nevertheless, tensioning results from the collar section 10 bearing against the lip portion of the barrel 52. The load tension causes the stabilization members 20*a*-20*d* to tighten to against the upper portion 60*a* (having a wider comparative girth relative to the midpoint 62 than in many other barrel types), and retentively contain the lifted barrel within the space they bound.

To adapt to maneuvering articles of other shapes and sizes, such as square- or triangular-shaped barrels, the collar section 10 may be reconfigured in shape. Instead of a two-piece hinged collar section, for example, the collar section may be formed alternatively with three, four, or other numbers of sections coupled together by lengths of chain so to easily conform to an article having a circular cross-section, square cross-section, triangular cross-section, or the like.

In the exemplary embodiment shown, the collar section 10 is formed with multiple arm portions each implemented as a rigid band-like structure defining an arcuate contour. This is but one example of the various structural configurations for collar section 10 that may be employed to suit such application-determined factors as: the shape and form of the article to be lifted, the range of weights to be hoisted, the environmental conditions to which the apparatus is to be exposed, and the like. For example, one or more of the arm portions may be formed with something other than the generally flat, band-like contour illustrated. To best suit the requirements of the intended application, for instance, one or more of the arm portions may be formed with other sectional contours, and may define a non-arcuate shape. Where the application so requires, one or more of the arm portions may be formed with non-rigid, even generally flexible structure. The collar section may also be formed with a one piece integrated structure having free ends that are releasably interlocked to define a loop about the article to be lifted.

The hoist apparatus 1 should be strong while not being overly cumbersome. In other words, the hoist apparatus should preferably (though not necessarily) weigh less than the barrels it is attempting to lift. The support section 5 having the crossed frame configuration as shown in FIG. 2 provides an efficient way to obtain strength without undue weight. Preferably, various portions of the hoist apparatus 1 are preferably made of heavy duty steel or iron, for example, but may be made of aluminum or any other suitable metallic or non-metallic material (or combinations thereof) that provides sufficient strength and rigidity to meet the requirements of the particularly intended application, and which preferably optimizes the strength-to-weight ratio to a degree sufficient for the intended application.

Other modifications may be made to the structure previously discussed herein and shown in the accompanying figures without departing from the spirit or scope of the present invention. For instance the number of stabilization members 20*a*-20*d* extending between the support section 5 and the collar section 10 may be altered so long as they remain of same or comparable length and disposed along the support section 5 in such manner as to ensure that the collar section 10 stays substantially level with respect to the support section 5 during lifting and movement.

In other alternate embodiments it may be desirable to replace the four arm crossed frame 5 with a three-arm frame or other frame configuration. Such alternate configuration would increase the circumferential distance between adjacent lifting chains from about 90 degrees to about 120 degrees, for instance, yet may be used in conjunction with additional side chains between the lifting chains to prevent the barrel from escaping through the lifting chains as it is hoisted and maneuvered.

Still further, the lifting chains 20*a*-20*d* may be replaced with more rigid bar-like members. Such would make it a bit more difficult to maneuver around barrels and limit the self-adjusting, self-stabilizing characteristics of the apparatus but may be desirable for applications where barrels are sparsely stored (allowing more room to work a collar section about each barrel) and are very heavy.

In other embodiments, additional chains may be added to the four arm crossed frame of support section 5. The number of chains will typically determine how much tension is endured by one particular chain. Employing more chains tends to require less tension on any one chain, so it helps to employ more chains than less chains in that regard.

Alternatively, the crossed frame may be altogether replaced with a strong ball-type structure. Chains would attach to a common point of the ball and extend downward to a connection point along the circumference of the collar section. In such an embodiment, the ball would be attachable directly to a shackle, for instance, on an excavator machine. In such an embodiment it would be desirable to use chains of such suitable length that once the barrel is hoisted, the chains do not press tightly against the outer edges of the barrel to squeeze and contort the barrel excessively and cause it to open (risking the escape of fill material therefrom), and the chains do not otherwise apply undue stress on the barrels themselves.

The collar section may be automatically actuated (by hydraulic means for instance), rather than manually actuated. Moreover, the hoist apparatus may be formed as a direct attachment for the excavator itself, rather than as an extraneous device that is secured to another attachment on the excavator. For instance, a quick connect attachment may be used to tie directly into a holder on the excavator.

Incorporating a power driven hinge to releasably lock the collar section 10 would reduce manpower as there would only need to be one person driving the machine and controlling opening and closing of the hinge rather than needing an additional person on the ground to latch the collar section 10 once placed around a barrel to be hoisted. The hydraulically actuated collar section would include, for example, piston arms connected to the collar section that would push or pull against another suitably stable portion of the apparatus.

As a reinforcing safety feature, additional loose chains can be added to cross underneath the collar section so that in case there is some failure—for instance, if the collar section were to come apart—the barrel will not fall straight through but is caught by the supporting chains. Such supporting chains would extend from the attachment rings or the collar section 10 itself. Alternatively, the supporting chains may be tied to the lifting chains 20*a*-20*d* or may extend down from the frame 5.

As a further reinforcing and safeguarding feature, the overall structure may be reinforced by cross beams, such as gussets, extending between arms of the crossed frame 5 that are, for example, approximately 90° offset in angle. Disposing these and other suitable brace measures between the cross beams contributes to an even sturdier structure.

Although this invention has been described in connection with specific forms and embodiments thereof, it will be appreciated that various modifications other than those discussed above may be resorted to without departing from the spirit or scope of the invention as defined by the appended claims. For example, functionally equivalent elements or processes may be substituted for those specifically shown and described, certain features may be used independently of other features, and in certain cases, particular locations of the elements or processes may be reversed or interposed, all without departing from the spirit or scope of the invention as defined by the appended claims.

What is claimed is:

1. A self-stabilizing hoist apparatus for a lifting system comprising:

a support section for securement to the lifting system;

a collar section coupled to said support section by a plurality of stabilization members extending therebetween, said collar section being reconfigurable between open and closed configurations and including a plurality of arm portions, each of said arm portions being pivotally coupled to at least one other of said arm portions, at least first and second ones of said arm portions each terminating at a free end; and at least one reinforcement member connected to extend between a pair of stabilization members, said reinforcement member being configured to supportingly engage a portion of a container when captured by said collar section;

wherein said collar section in the closed configuration defines a loop for capturing the container, with the free ends of said first and second arm portions releasably locked to one another, the free ends of said first and second arm portions being detached from one another in the open configuration to interrupt the loop.

2. The self-stabilizing hoist apparatus according to claim 1, wherein said support section includes an attachment member secured thereto for reversible coupling to a securement portion of the lifting system whereby said hoist apparatus is suspended from the lifting system in a balanced manner.

3. The self-stabilizing hoist apparatus according to claim 1, wherein said support section includes a crossed frame defining a plurality of cross members, each cross member connected to at least one of said stabilization members.

4. The self-stabilizing hoist apparatus according to claim 1, further comprising at least one lock member detachably coupled to the free ends of said first and second arm portions for releasably locking said first and second arms portions to retain the loop in the closed configuration.

5. The self-stabilizing hoist apparatus according to claim 4, wherein said support section includes at least one housing unit for retentively storing said releasable lock member.

6. The self-stabilizing hoist apparatus according to claim 4, wherein said first and second arm portions each define a connection bore at the free end thereof for mating engagement by the releasable lock member.

7. The self-stabilizing hoist apparatus according to claim 1, wherein said collar section is selectively adjustable in loop size in the closed configuration.

8. The self-stabilizing hoist apparatus according to claim 1, wherein said arm portions are radially displaceable with respect to one another such that said loop defined by said collar section in the closed configuration is adjustable for capturing containers of various sizes.

9. The self-stabilizing hoist apparatus according to claim 1, wherein said first and second arm portions are each coupled in pivotally displaceable manner to one another.

10. A self-securing hoist apparatus for a lifting system comprising:

a support section for securement to the lifting system; and, a collar section coupled to said support section by a plurality of stabilization members extending therebetween, said collar section being reconfigurable between an open configuration and a closed configuration and including a plurality of arm portions, each of said arm portions being pivotally coupled to at least one other of said arm portions, at least first and second ones of said arm portions each terminating at a free end, said arm portions being displaceable with respect to one another to selectively adjust the space peripherally bounded thereby when in the closed configuration; and, a plurality of lock members of different sizes, said lock members defining different bridging lengths between the free ends of said first and second arm portions when releasably locked thereto;

wherein said collar section in the closed configuration defines a self-securing cuff about a container, with the free ends of said first and second arm portions releasably locked to one another by one of said releasable lock members, the free ends of said first and second arm portions being detached from one another in the open configuration to interrupt the cuff.

11. The self-securing hoist apparatus according to claim 10, wherein said support section includes a crossed frame defining a plurality of cross members, each cross member connected to at least one of said plurality of stabilization members.

12. The self-securing hoist apparatus according to claim 10, further comprising an attachment member coupled thereto for releasable coupling to a securement portion of the lifting system, whereby said hoist apparatus is suspended from the lifting system in a balanced manner.

13. The self-securing hoist apparatus according to claim 10, further comprising at least one side chain connected at opposing ends to a pair of adjacent stabilizing members and extending therebetween, said side chain being configured to engage an outer surface of the container and provide support thereto when said collar section is cuffed about the container.

14. A self-stabilizing hoist apparatus for a lifting system comprising:

a support section for securement to the lifting system, said support section defining a frame with a plurality of first connection portions and an attachment member positioned thereon for releasable coupling to a securement portion of the lifting system whereby said hoist apparatus is suspended from the lifting system;

a reconfigurable collar section coupled to said support section by a plurality of collapsible stabilization members, each one of said stabilization members extending between said support section and said collar section, said collar section being selectively adjustable between an open configuration and a closed configuration and including at least a first arm portion and a second arm portion, said first and second arm portions being pivotally displaceable about one end and terminating at an opposing free end, said arm portions being displaceable in cooperative manner to adaptively adjust said collar section in shape and size about a barrel when in the closed configuration;

at least one reinforcement member connected to a pair of adjacent stabilization members and extending therebetween, said reinforcement member being configured to engage an outer surface of the barrel and provide support thereto when the collar section is looped about the barrel; and, at least one releasable lock member releasably engaging the free ends of said first and second arm portions in an active position to maintain said collar section in the closed configuration, wherein said collar section in the closed configuration defines a loop for capturing the barrel, with the free ends of said first and second arm portions releasably locked to one another by said releasable lock member, the free ends of said first and second arm portions being detached from one another in the open configuration to interrupt the loop.

15. The self-stabilizing hoist apparatus according to claim 14, wherein each of said arm portions is pivotally displaceable with respect to at least one other.

16. The self-stabilizing hoist apparatus according to claim 15, comprising a plurality of lock members of different size, said lock members defining different bridging lengths between the free ends of said first and second arm portions when releasably locked thereto.

17. The self-stabilizing hoist apparatus according to claim 16, wherein each of said stabilization members includes a chain link structure.

18. A self-stabilizing hoist apparatus for a lifting system comprising:

a support section for securement to the lifting system;

a collar section coupled to said support section by a plurality of stabilization members extending therebetween, said collar section being reconfigurable between open and closed configurations and including a plurality of arm portions, each of said arm portions being pivotally coupled to at least one other of said arm portions, at least first and second ones of said arm portions each terminating at a free end; and at least one lock member detachably coupled to the free ends of said first and second arm portions for releasably locking said first and second arm portions in the closed configuration, wherein, said support section includes at least one housing unit for retentively storing said lock member, wherein said collar section in the closed configuration defines a loop for capturing a container, with the free ends of said first and second arm portions releasably locked to one another, the free ends of said first and second arm portions being detached from one another in the open configuration to interrupt the loop.

* * * * *